US006036742A

United States Patent [19]

Leutner et al.

[11] Patent Number: 6,036,742

[45] Date of Patent: Mar. 14, 2000

[54] FINELY DIVIDED PHOSPHORUS-CONTAINING IRON

[75] Inventors: Bernd Leutner, Frankenthal; Gabriele Friedrich, Ludwigshafen; Reinhold Schlegel, Hassloch, all of Germany

[73] Assignee: BASF Aktiengesellschaft, Ludwigshafen, Germany

[21] Appl. No.: 09/022,674

[22] Filed: Feb. 12, 1998

[30] Foreign Application Priority Data

Feb. 19, 1997 [DE] Germany ..... 197 06 524

[51] Int. Cl.[7] ..... B22F 1/00

[52] U.S. Cl. ..... 75/349; 75/351; 75/362; 75/363

[58] Field of Search ..... 75/349, 351, 362, 75/363, 413, 433; 423/299

[56] References Cited

U.S. PATENT DOCUMENTS 1,268,849 6/1918 Jeffs .
3,376,129 4/1968 Syrkin et al. .
4,056,386 11/1977 McEwan et al. .
4,929,468 5/1990 Mullendore .
5,085,690 2/1992 Ebenhoech et al. .

OTHER PUBLICATIONS

*Gmelins Handbuch der Anorg. Chem.*, vol. Iron, part A, Section II, pp. 1784–1785.

*J. Va. Sci. Technol.*, A4, 1986, pp. 2943–2948.

*Primary Examiner*—Ngoclan Mai
*Attorney, Agent, or Firm*—Keil & Weinkauf

[57] ABSTRACT

Finely divided phosphorus-containing iron is prepared by reacting iron pentacarbonyl with a volatile phosphorus compound, in particular $PH_3$, in the gas phase. The resulting phosphorus-containing iron powders and iron whiskers have a particularly low content of extraneous elements.

5 Claims, No Drawings

FINELY DIVIDED PHOSPHORUS-CONTAINING IRON

The present invention relates to finely divided phosphorus-containing iron, a process for its preparation and an apparatus for carrying out the process.

Certain applications, for example in powder metallurgy, require fine metal powders having defined mechanical properties. A powder which is particularly suitable for such applications is carbonyl iron powder which is prepared by a classical process by thermal decomposition of iron pentacarbonyl in the gas phase. The particularly favorable properties such as the good sinterability of the powder result from its purity, its low formation temperature and the small size, large surface area and spherical shape of the powder particles. The use of additional elements as alloy constituents enables, at a very low content of further secondary constituents, the mechanical properties of the powder to be influenced in a targeted manner. Possibilities here are, in particular, the use of phosphorus for preparing powders of phosphorus-iron alloys having a defined phosphorus content, which determines the hardness or brittleness of the powders and the parts made thereof.

Gmelins Handbuch der Anorganischen Chemie, volume "Iron", part A, section II, 8th edition 1934/1939, pages 1784–85 describes various classical methods of preparing iron-phosphorus alloys. Iron-phosphorus alloys are formed on heating metallic iron with elemental phosphorus, in the reduction of compounds of phosphorus in the presence of iron and in the simultaneous reduction of compounds of iron and of phosphorus.

Some of the processes mentioned therein require high reaction temperatures. The product is obtained as an amorphous, slag-like mass and can contain a high proportion of secondary constituents.

An alloy of iron and phosphorus, ferrophosphorus, is formed as a by-product in the production of phosphorus in an electric furnace. The iron oxide present in the raw materials for phosphorus production is reduced to iron and takes up phosphorus. Ferrophosphorus contains 20–27% by weight of phosphorus and, as secondary constituents, from 1 to 9% by weight of silicon and further metals such as titanium, vanadium, chromium and manganese.

Ferrophosphorus is unsuitable for applications which require a high-purity iron powder having a defined phosphorus content.

Bourcier et al., J. Vac. Sci. Technol. A 4 (1986), pages 2943–48 describes the production of iron-phosphorus films by decomposition of $PH_3$ and iron pentacarbonyl. In this process, known as PECVD (plasma enhanced chemical vapor deposition), a plasma is generated in a gas discharge from a gas mixture in which the components are present in diluted form in a carrier gas stream of hydrogen, and the films are deposited from the plasma onto a heated nickel substrate surface. The ultrathin, amorphous films thus produced have an iron content of 67%, an oxygen content of 2% and a carbon content of 10%.

It is an object of the present invention to provide a process for preparing finely divided phosphorus-containing iron having a phosphorus content which can be varied within wide limits and having a low proportion of secondary constituents. In particular, it is an object of the invention to provide a process for preparing finely divided phosphorus-containing iron based on the process for preparing carbonyl iron powder.

We have found that this object is achieved by starting from known processes for preparing phosphorus-containing iron from a phosphorus-containing component and an iron-containing component and, according to the present invention, reacting iron pentacarbonyl [$Fe(CO)_5$] with a phosphorus compound in the gas phase.

Suitable phosphorus compounds are readily decomposable phosphorus compounds which are volatile or are gaseous at room temperature, preferably phosphines or alkylphosphines. Examples are phosphine ($PH_3$), diphosphine ($P_2H_4$), methylphosphine, dimethylphosphine and trimethylphosphine. For the purposes of the present invention, phosphorus compounds also include phosphorus vapor. Preference is given to using $PH_3$.

An advantage of the process of the present invention is that the phosphorus content of the finely divided phosphorus-containing iron powder can be varied within wide limits by selection of the gas composition. In principle, the ratio of iron pentacarbonyl to the phosphorus compound in the gas mixture can be selected as desired, with iron pentacarbonyl generally being used in an excess based on weight. Preference is given to using an excess of iron pentacarbonyl of at least 10:1, particularly preferably 15:1, in particular from 15:1 to 300:1.

The resulting finely divided phosphorus-containing iron can have a phosphorus content up to 50% by weight. The phosphorus content is preferably from 0.1 to 20% by weight. The phosphorus content can be determined by known methods of elemental analysis, for example wet chemically, by atomic emission spectroscopy or by X-ray analysis in scanning electron microscopy.

The reaction can be carried out in a heatable decomposition apparatus as is used, for example, for the preparation of carbonyl iron powder by thermal decomposition of iron pentacarbonyl and described in Ullmann's Encyclopedia of Industrial Chemistry, 5th edition, Vol. A 14, page 599 or in DE 3 428 121 or DE 3 940 347. Such a decomposition apparatus comprises a preferably upright tube made of a heat-resistant material such as quartz glass or V2A steel and surrounded by a heating device, for example consisting of heating tapes, heating wires or a heating jacket through which a heating medium flows. The heating device is preferably divided into at least 2 segments to provide one zone having a relatively low temperature and one zone having a higher temperature. The gases are premixed and introduced into the decomposition tube, preferably from the top, with the gas mixture first passing through the lower-temperature zone. The temperature of the hotter (bottom) pipe section is preferably at least 20° C. above that of the cooler pipe section. Such a temperature profile presumably favors the formation of the finely divided phosphorus-containing iron by means of the convective gas flow in the region of the temperature gradient. The finely divided phosphorus-containing iron formed can be separated out in a separator by known methods using gravity or centrifugal force and/or using filters. The mass of the particles formed is preferably sufficiently high for these to run downward out of the decomposition apparatus without problems and to be collected in a receiver. In the case of finer particles which would be entrained by the gas stream, separation can be achieved by deflection, once or a plurality of times, of the gas stream in the separator and/or by use of suitable filters.

The reaction is carried out at a temperature above room temperature. The temperature is preferably above 200° C., particularly preferably from 250° C. to 375° C.

In a preferred embodiment, the reaction is carried out in the presence of ammonia which presumably accelerates the decomposition of iron pentacarbonyl into iron and carbon monoxide. The proportion of ammonia in the gas mixture is preferably from 0.1 to 10% by volume.

The reaction is preferably carried out with exclusion of atmospheric oxygen, and can be carried out in the presence of additional carrier gases. Preference is given to using carbon monoxide as additional carrier gas. The CO content of the gas mixture is preferably from 10 to 90%. The total pressure in the reaction is preferably from 1 to 5 bar; the reaction is particularly preferably carried out at atmospheric pressure.

A particular advantage of the process of the present invention is the high purity of the finely divided phosphorus-containing iron obtained; this high purity is attributable to the use of particularly pure, gaseous starting materials. Thus, the carbon content is generally below 1% by weight, the nitrogen content below 1% by weight and the hydrogen content below 0.5% by weight.

The phosphorus-containing iron powders obtained according to the present invention preferably have the following contents of extraneous elements: nickel<100 ppm, chromium<150 ppm, molybdenum<20 ppm, arsenic<2 ppm, lead<10 ppm, cadmium<1 ppm, copper<5 ppm, manganese<10 ppm, mercury<1 ppm, sulfur<10 ppm, silicon <10 ppm and zinc<10 ppm. The extraneous element content can be determined by means of atomic absorption spectroscopy. The low extraneous element content, which is usually below the detection limit of atomic absorption spectroscopy, clearly distinguishes the phosphorus-containing iron prepared by the process of the present invention from phosphorus-containing iron prepared by known methods.

Another advantage is that, in the process of the present invention, the phosphorus-containing iron is obtained in finely divided form and further mechanical treatment, for example by milling, can thus be omitted.

In the reaction, the finely divided phosphorus-containing iron is obtained either as powder consisting essentially of spherical particles or as fine, polycrystalline threads, known as whiskers.

The phosphorus-containing iron powder of the present invention consists essentially of spherical particles having a mean diameter of from 0,3 to 20 $\mu$m, preferably from 1 to 10 $\mu$m. Mean diameters can be determined by known methods, either photographically or by light scattering methods, for example using a laser light scattering apparatus.

The phosphorus-containing iron whiskers of the present invention consist essentially of thread-like aggregates of spheres having a sphere diameter of from 1 to 3 $\mu$m.

A further advantage of the process of the present invention is that selection of the reaction parameters such as pressure, temperature and flow velocity enables either powder or whiskers to be obtained. The mean particle diameter of the powder can also be varied by selection of these parameters.

The mechanical properties of phosphorus-iron alloys are determined, in particular, by their phosphorus content. The phosphorus-containing iron powders of the present invention are therefore used particularly advantageously for applications in which the setting of particular mechanical properties such as hardness or brittleness is important.

Preferred applications of the finely divided phosphorus-containing iron of the present invention are in the field of powder metallurgy. Powder metallurgy is a specific field of materials production and processing in which pulverulent metallic materials are processed by pressing and/or sintering to form shaped bodies. Preferred applications are, for example, die pressing and metal injection molding.

The finely divided phosphorus-containing iron of the present invention can be used alone or as a mixture with other metal powders, eg. of nickel, cobalt or bronze, for producing iron alloys.

According to the abovementioned process, the finely divided phosphorus-containing iron of the present invention can be used, for example, for the embedding of industrial diamonds in cutting and grinding tools and also for producing metal ceramics, known as cermets.

The invention is illustrated by the examples below.

EXAMPLES 1 to 13

The apparatus for the thermal decomposition of iron pentacarbonyl [$Fe(CO)_5$] and phosphine ($PH_3$) comprises a V2A steel decomposition tube having a length of 1 m and an internal diameter of 20 cm. The decomposition tube is heated by means of heating tapes and the temperature $T_2$ set in the bottom third of the tube is at least 20° C. higher than the temperature $T_1$ in the upper part of the tube. The $Fe(CO)_5$, which is stored in liquid form, is vaporized in an electrically heated reservoir and the vapor together with $PH_3$ and CO (about 15 l/h) and $NH_3$ (about 1 l/h) is introduced into the decomposition tube from the top. In the decomposition tube, the phosphorus-containing iron powder is formed with liberation of CO and $H_2$. The phosphorus-containing iron powder formed runs downward out of the decomposition apparatus and is collected in a glass flask.

To check the $PH_3$ content of the off-gas, the off-gas is passed through mercury(II) chloride solution and the precipitate formed is analyzed for phosphorus. Only traces of phosphorus were detected, from which it can be concluded that the $PH_3$ used has reacted completely. The elemental composition is determined by means of X-ray spectroscopy in scanning electron microscopy.

Mean particle diameters are determined by means of a laser light scattering apparatus.

EXAMPLE 14

The preparation described in the above examples was repeated, but the reaction was now carried out in the absence of ammonia.

The reaction products and the characterization of the process products are shown in the following table.

| Example No. | $T_1$ [° C.] | $T_2$ [° C.] | $Fe(CO)_5$ [g] | $PH_3$ [g] | Fe content [% by weight] | P content [% by weight] | C content [% by weight] | H content [% by weight] | N content [% by weight] | BET surface area [$m^2/g$] | Fill density [g/ml] |
|---|---|---|---|---|---|---|---|---|---|---|---|
| 1 | 267 | 304 | 316 | 4 | 94.2 | 4.2 | 0.9 | <0.5 | 0.8 | 0.31 | 1.4 |
| 2 | 260 | 293 | 850 | 3 | 97.7 | 1.1 | 0.57 | <0.5 | 0.6 | 0.27 | 3.4 |
| 3 | 263 | 298 | 770 | 7 | 96.2 | 2.4 | 0.5 | <0.5 | 0.56 | 0.24 | 3.2 |
| 4 | 263 | 294 | 850 | 16 | 93.8 | 4.4 | 0.47 | <0.5 | 0.44 | 0.25 | 3.0 |
| 5 | 269 | 301 | 850 | 24 | 91.5 | 7.2 | 0.44 | <0.5 | 0.35 | 0.31 | 2.5 |

-continued

| Example No. | $T_1$ [° C.] | $T_2$ [° C.] | $Fe(CO)_5$ [g] | $PH_3$ [g] | Fe content [% by weight] | P content [% by weight] | C content [% by weight] | H content [% by weight] | N content [% by weight] | BET surface area [$m^2/g$] | Fill density [g/ml] |
|---|---|---|---|---|---|---|---|---|---|---|---|
| 6 | 269 | 301 | 880 | 32 | 89.9 | 9.2 | 0.39 | <0.5 | 0.31 | 0.33 | 2.0 |
| 7 | 265 | 300 | 813 | 57 | 83.9 | 15.6 | 0.24 | <0.5 | 0.20 | 0.30 | 2.0 |
| 8 | 264 | 311 | 880 | 69 | 81.8 | 17.8 | 0.13 | <0.5 | 0.19 | 0.31 | 2.3 |
| 9 | 268 | 305 | 3000 | 112 | 88.8 | 9.5 | 0.45 | <0.5 | 0.24 | 0.29 | 2.1 |
| 10 | 268 | 297 | 2000 | 77 | 89.5 | 10.2 | 0.40 | <0.5 | 0.21 | 0.34 | 2.1 |
| 11 | 328 | 370 | 1000 | 36 | 88.4 | 10.4 | 0.59 | <0.5 | 0.32 | 0.5 | 0.6 |
| 12 | 331 | 362 | 1000 | 16 | 92.8 | 5.1 | 0.69 | <0.5 | 0.44 | 0.78 | 1.0 |
| 13 | 334 | 357 | 1000 | 60 | 83.5 | 14.8 | 0.45 | 0.6 | 0.29 | x | 0.7 |
| 14 | 265 | 299 | 880 | 34 | 88.0 | 10.9 | 0.9 | <0.5 | <0.5 | 0.35 | 1.7 |

We claim:

1. A process for preparing finely divided phosphorus-containing iron, which process comprises reacting iron pentacarbonyl with a phosphorous-containing compound in the gas phase, and recovering the finely divided phosphorous-containing iron; wherein the recovered finely divided phosphorous-containing iron has a phosphorous content of from 0.1 to 50% by weight of the iron; and wherein the recovered finely divided phosphorous-containing iron is in the form of a powder consisting essentially of particles having a mean diameter of from 0.3 to 20 $\mu$m or as fine, polycrystalline threads consisting essentially of thread-like aggregates of spheres having a sphere diameter of from 1 to 3 $\mu$m.

2. The process of claim 1 wherein the phosphorous content of the finely-divided phosphorous-containing iron is from 0.1 to 20% by weight of the iron.

3. The process of claim 1, wherein iron pentacarbonyl is reacted with phosphine.

4. The process of claim 1, wherein the reaction is carried out in the presence of ammonia.

5. The process of claim 1, wherein the reaction is carried out at above 200° C.

* * * * *